United States Patent [19]

Oestreich

[11] 4,429,521

[45] Feb. 7, 1984

[54] DEVICE FOR SZ-STRANDING BY USING A TUBE STORE

[75] Inventor: Ulrich Oestreich, Munich, Fed. Rep. of Germany

[73] Assignee: Siemens Aktiengesellschaft, Berlin & Munich, Fed. Rep. of Germany

[21] Appl. No.: 378,423

[22] Filed: May 14, 1982

[30] Foreign Application Priority Data

Jun. 5, 1981 [DE] Fed. Rep. of Germany ..... 3122473

[51] Int. Cl.[3] ..... D07B 3/00; D07B 7/00

[52] U.S. Cl. ..... 57/294

[58] Field of Search ..... 57/6, 293, 294, 138

[56] References Cited

U.S. PATENT DOCUMENTS 3,460,334 8/1969 Lawrenson et al. ..... 57/293 X
4,056,925 11/1977 Vogelsberg ..... 57/293
4,214,430 7/1980 Vogelsberg et al. ..... 57/294 X
4,359,857 11/1982 Oestereich ..... 57/294 X

FOREIGN PATENT DOCUMENTS 1305559 2/1973 United Kingdom .

*Primary Examiner*—Donald Watkins
*Attorney, Agent, or Firm*—Hill, Van Santen, Steadman & Simpson

[57] ABSTRACT

A device for SZ-stranding, which includes a tube store mounted in a frame for rotation on its axis, at least one stranding disk associated with the tube store and a device for rotating said tube and disk in a reversing fashion characterized by a tubular sleeve being concentrically disposed on a portion of the tube store and being mounted in the device to rotate at a speed different than the speed of rotation for the tube store. The tubular sleeve can be disposed either adjacent the input which is usually defined by a guide disk or adjacent to the exit and the stranding disk. In one embodiment, two tubular sleeves are provided with one being adjacent the entrance and the guide disk and the other being connected to rotate with the stranding disk at a speed different than the speed of rotation for the tube store.

13 Claims, 2 Drawing Figures

DEVICE FOR SZ-STRANDING BY USING A TUBE STORE

BACKGROUND OF THE INVENTION

The present invention is directed to a device for SZ-stranding, which device utilizes a tube store, which is mounted in the frame for rotation on its axis, at least one stranding disk associated with the tube store for guiding the elements being stranded along the surface of the tube store and a drive arrangement for rotating the disk and tube store in a rotating fashion.

Prior Art

A stranding device for SZ-stranding a plurality of elements which includes means for guiding and storing the elements as they are stranded with an SZ-stranding is disclosed in German Letters Pat. No. 682,267. In this device, the tube store at its discharge end is provided with a rotated stranding disk. The basic construction of such a stranding installation and device as discussed in the German patent is illustrated in FIG. 1 by the device 10. The device 10 includes a tube store RO, which serves as both a guide and storage member. The tube store RO is mounted for rotation on its axis and by means of a reversibly operating drive device the tube store RO can be alternately rotated for a specific amount of time in the clockwise and then in the counter-clockwise direction as indicated by the arrow RE. The particular means for driving the tube can utilize a toothed wheel or gear which is applied on the extension of the tube store RO which toothed wheel or gear is engaged by a toothed belt. As illustrated, the device 10 includes an aperture guide disk FS, which has a corresponding number of bores or passageways to accomodate each of the elements VE being stranded. As illustrated, the guide disk FS is mounted stationarily or fixedly in a portion of a frame member or housing 11. At the output 12 of the store RO or adjacent thereto, a stranding disk VS is provided and is mounted for rotation in a portion 13 of the frame or housing by a bearing LA. The disk VS may be fixedly connected to the tube store RO or be provided with a second separate drive in which case it will rotate relative to the tube store RO. The disk VS will exhibit a corresponding axial bore to accomodate each of the elements VE being stranded. The elements VE are thus guided at the output of the SZ stranding device via a stranding nipple VN.

Depending upon the particular frictional engagement between each of the elements VE and the surface of the tube RO as each of the elements VE is wound onto the exterior surface of the tube store RO, a transfer will create a torque which is applied to each of the elements which will vary from the location of the strongest winding-on in the region of the guide disk VS to a location of a weaker winding-on in the region of the stranding disk VS. Since the stranding disk VS itself represents a winding break and depending upon a distribution of the frictional force, torque from the entry region at the guide disk FS are transferred to the stranding region namely more rapidly or more slowly depending upon a torsional strength of each of the elements VE. In the stranding region which is the surface of the tube store RO between disks FS and VS, the braking torques are compensated directly or in a delayed fashion at the stranding disk VS, so that the stranding itself proceeds with a minimum torsion and no torsion whatsoever. In an extreme case, even over-compensation is conceivable. The forced unwinding at the stranding output adjacent the stranding disk VS will lead most often to a desired enlarged length of the lay during stranding on the tube store RO and simultaneously with increasing of the filling of the tube RO which will lead to an undesired compacting or concentration of the lays for example adjacent the entry region which is at the guide disk FS. The distribution of the stranding element VE over the length of the tube store RO thus, as apparent from the illustration is not uniform. The winding in the region of the guide disk FS acquires an axial component which causes a reinforcement of this particular process.

A too strong concentration of the lays with a smaller pitch will occur primarily when the particular element being stranded on the tube store RO has a soft cover such as a plastic cover which may be formed of polyvinyl chloride, a polyethylene or a rubber and these covers are used for thin metallic conductors and also for light waveguides. In addition, this problem with an increased frictional force will also occur with those light waveguides which have a soft covering. Such an excessively strong concentration not only leads to a greater frictional force, but in extreme instances can even cause undesirable kinking or bending of the particular element before it reaches the guide disk FS.

SUMMARY OF THE INVENTION

The present invention is directed to providing a device for SZ-stranding, which device avoids to a great extent as possible and with a simple means an excessively strong concentration of the particular stranding elements on the tube store.

In accordance with the invention, this is achieved in an improvement in the device for SZ-stranding, which device includes means for guiding and storing elements being stranded, said means including a tube store having a stranding surface and being mounted in a frame for rotation on its axis, at least one stranding disk associated with said tube store and means for rotating said tube store and disk in a reversing fashion. The improvement comprises sleeve means being disposed to extend over and cover a portion of the stranding surface of the tube store and support means for mounting said sleeve means in the frame so that it does not rotate at the same speed as the stranding disk and the tube store. Preferably, the sleeve means comprises a tubular sleeve, which is concentrically arranged on the tube store and will prevent a too strong of winding on of the particular stranding elements. Thus, the concentration of the lays of the strands can be attenuated in a direct fashion and a more uniform distribution of the particular elements being stranded can be guaranteed along the length of the tube store.

The support means, which mounts the sleeve means preferably mounts the sleeve means so that it may be axially displaced along the surface of the tube store to extend to cover different amounts of the stranding surface. For example, an amount is between 5 and 20 percent of the total stranding surface of the tube store with the preferred amount being approximately 10% of the length of the stranding surface of the tube store. The sleeve means may be positioned at the input end of the device, which preferably is provided with a stationary guide disk, and the sleeve means may either be stationarily supported in the frame or housing or be free to rotate relative to both the stationary guide disk and the rotating tube store.

The sleeve means, which may be a tube which preferably has a wall thickness so that the outer diameter of the tube is only slightly larger than the outer diameter of the tube store, may also be mounted adjacent to the exit of the stranding device and thus adjacent to the stranding disk. The stranding disk may be connected to the tube store or may be free to rotate relative to the tube store in the housing of the device and in such a case is independently driven. If the stranding disk is being independently driven, the sleeve means, when adjacent the stranding disk, may be connected to the stranding disk or may also be free to rotate relative to both the stranding disk and the tube store. If attached to the stranding disk, it may be rotating at a speed higher than the speed of rotation of the tube store if the stranding disk is independently driven at a higher rate of rotation.

DESCRIPTION OF THE PREFERRED EMBODIMENTS

Figure 1:
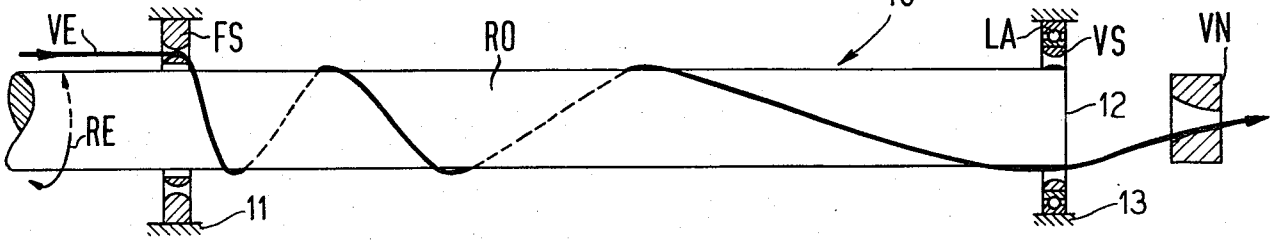
FIG 1 (PRIOR ART)
FIG. 1 is a schematic longitudinal view of a portion of a stranding device in accordance with the prior art.

The principles of the present invention are particularly useful in a device generally indicated at 20 for SZ-stranding which device 20 is an improvement of the prior art device 10 of FIG. 1. The device 20 has many elements or members which are similar or the same as the parts of the device 10 and these elements are identified by the same element numbers. As illustrated, the device 20 has a rotatable tube store RO, which adjacent an input end has a guide sleeve FS that is stationarily attached to the housing or a member of the housing 11. At an exit end 12, the store RO has a stranding disk VS, which is mounted in a portion 13 of the housing or frame by the bearing LA. As illustrated, the stranding disk VS is attached to the tube RO to rotate therewith on its axis. The tube store RO, as in the prior art device 10, is provided with means which will rotate it for a period of time in a clockwise direction and then in the reverse counterclockwise direction about its axis as indicated by the arrow RE.

To avoid the undesired concentration effects, for example in the region adjacent the entry which is defined by the guide disk FS, sleeve means, such as a tubular sleeve HL, are provided. The sleeve means formed by the sleeve HL, is mounted by support means, which is illustrated as being the guide disk FS so that it will not rotate at the same speed as the tube store RO. Thus, when an element such as VE passes through an aperture in the guide disk FS, it can be wound on the sleeve HL only slightly until it has been passed off of an end 22 onto the rotating tube store RO. As it moves axially along the sleeve HL and over the end 22 onto the surface of the rotating tube store RO, the rotational force of the tube store will cause it to wind into a helical coil. Thus, any winding that occurs on the tubular sleeve HL is strictly due to a transfer of the frictional forces on that portion of the element engaged on the surfaces of the tube store RO. Thus, some winding operation will occur in the region of the tube or sleeve forming the sleeve means HL; however, this is by comparison to the device 10 of FIG. 1 at a substantially slower rate so that the length of the lay in the region of the sleeve means HL remains greater than the corresponding left-hand portion of the tube store RO of the device 10 of FIG. 1. Thus, undesirable excessively strong concentration of the lay of the elements being stranded is avoided in the region adjacent to the entry of the element VE into the device 20.

The means for mounting the sleeve means HL can be adjustable to allow adjustment of the length of the tubular sleeve HL in an axial direction of the arrow AX. This axial displacement enables changing the amount of the stranding surface of the tube store RO which is covered and thus allows positioning of the terminating edge 22 to obtain the desired transition for the particular properties of the elements VE being stranded. It has been found expedient that the length of the sleeve HL which covers the stranding region for the tube store RO falls in the range of approximately 5 to 20% of the entire length of the stranding region for the tube store. Preferably this is approximately 10%.

It is expedient, if the external diameter of the sleeve HL is selected to be greater by as small an amount as possible to the exterior diameter of the tube store RO so that the amount of transition break or jump at the edge 22 between the sleeve HL and the tube store is as small as possible. The sleeve HL is expediently so dimensioned so that the tube store RO, which has a portion concentrically arranged therein, has a surface only weakly rubbing the interior surface of the tubular sleeve HL.

While as mentioned above, the guide disk FS can act as the means for mounting the sleeve HL, it is also possible that the means for mounting the sleeve mounts it to allow it to rotate at any speed other than the speed of the tube store RO. Thus, the means for mounting can mount the sleeve HS to be free to rotate in the guide disk FS. By being free to rotate, the tubular sleeve HL will be rotating at a speed lower than the rotational speed of the tube store. It is significant, that the sleeve HL does not rotate at the same speed as the tube store RO. Thus, the interior of the tubular sleeve HL relative to the diameter of the tube store RO is designed so that there is a significantly large slippage therebetween. Thus, the sleeve HL, when free to rotate can be rotated via frictional forces of the elements VE being stranded onto the devices. In these instances, the sleeve HL is simply mounted in a loose rotatable fashion.

Figure 2:
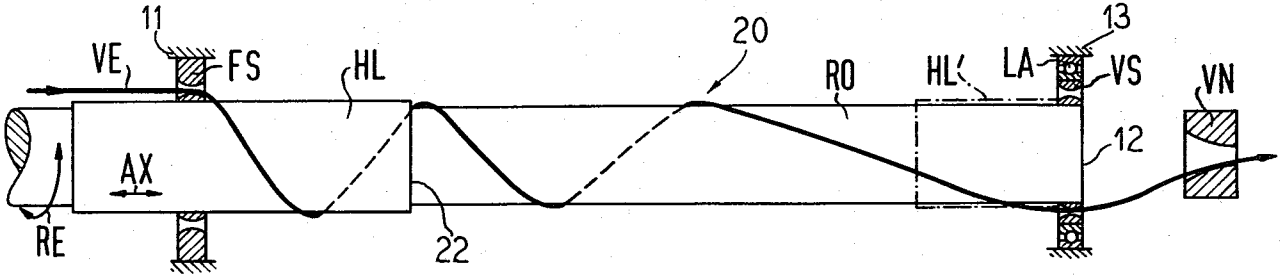
FIG. 2 is a schematic view of the improvement of the present invention for the stranding device.

In some instances, the concentration of the lays of elements VE at the output side of the tube store adjacent the end 12 can also occur, for example, if the tube store RO runs slower than the stranding disk VS. This would occur when the stranding disk VS is independently driven relative to the tube store RO. In order to counteract this influence and in addition to the sleeve HL illustrated in FIG. 2 at the input end, and independent thereof, a second sleeve means HL', which is illustrated in broken lines, can be provided in the region of the stranding disk VS. This sleeve HL' like the sleeve HL can be mounted in a similar fashion as the sleeve means HL so that it can be displaced along the axis of the tube store RO. This embodiment is primarily expedient if the stranding disk VS is driven independently and preferably more rapidly than the tube store RO. It can thus be expedient to fixedly connect this tubular sleeve or tube HL' with the stranding disk VS. Thus, the tube HL will not rotate at the same speed as the tube store RO. It is also possible that, the sleeve HL' is mounted rotatably free of the rotating disk VS so that its speed of rotation is between the speed of rotation of the stranding disk VS and the tube store RO.

While the illustrated embodiment shows the sleeve means HL comprising a tube, other means forming a substantial cover can be utilized. Also, the sleeve means, while being illustrated adjacent the input formed by the guide disk FS, can be placed only at the output formed by the stranding disk VS. If two sleeve means are provided, one will be provided at the input and one provided at the exit.

Although various minor modifications may be suggested by those versed in the art, it should be understood that we wish to embody within the scope of the patent granted hereon, all such modifications as reasonably and properly come within the scope of our contribution to the art.

I claim:

1. In a device for SZ-stranding, said device including means for guiding and storing elements being SZ stranded, said means including a tube store having a stranding surface and being mounted in a frame for rotation on its axis, at least one stranding disk associated with said tube store and means for rotating said tube and disk in a reversing fashion, the improvements comprising sleeve means being disposed to extend over and cover a portion of the stranding surface of said tube store and support means for mounting said sleeve means in the frame so that it does not rotate at the same speed as the tube store.

2. In a device according to claim 1, wherein the support means adjustably mounts the sleeve means to enable axial displacement of the sleeve means along the tube store to change the area of the stranding surface of the tube store being covered by said sleeve means.

3. In a device according to claim 1, wherein the support means stationarily mounts the sleeve means in said frame.

4. In a device according to claim 1, wherein the sleeve means comprises a tube having an outer diameter as small as possible over the diameter of the tube store so that the jump in the diameters of the tube forming the sleeve means and the tube store is as small as possible.

5. In a device according to claim 1, which includes a stationary guide disk having apertures for each of the elements being stranded in said device, saids support means mounting the sleeve means in a region adjacent to said stationary guide disk.

6. In a device according to claim 1, wherein said sleeve means covers a portion of the total length of the stranding surface of the tube store, said portion being in a range of 5 to 20% of the total length of the stranding surface.

7. In a device according to claim 6, wherein said portion is preferably 10% of the total length of the stranding surface.

8. In a device according to claim 1, wherein the support means mounts the sleeve means in at a region of the entry of the stranding elements to the stranding surface.

9. In a device according to claim 1, wherein the stranding disk is mounted for relative rotation on said tube store adjacent the output thereof, and said device includes means for independently rotating said stranding disk.

10. In a device according to claim 9, wherein the support means comprises said stranding disk.

11. In a device according to claim 10, wherein said means for rotating the stranding disk rotates said sleeve means and stranding disk at a speed higher than the speed of rotation for the tube store.

12. In a device according to claim 1, wherein the support means mounts the sleeve means on the tube store in the region of the exit from the stranding surface.

13. In a device according to claim 1, wherein the stranding disk is mounted for rotation independent of the tube store adjacent the exit of the stranding surface, said device including separate means for rotating the stranding disk at a speed different than the speed of rotation of the tube store, said device including a guide disk fixedly mounted in the frame of the device adjacent the entrance of the stranding surface, said support means mounting the sleeve means adjacent said guide disk and adjacent the entrance to the stranding surface, and said device including a second sleeve means being disposed adjacent the stranding disk for rotation therewith at a speed different than the speed of rotation of the tube store.

* * * * *